US005366524A

United States Patent [19]

Holcombe, Jr. et al.

[11] Patent Number: 5,366,524

[45] Date of Patent: Nov. 22, 1994

[54] CERAMIC-BONDED ABRASIVE GRINDING TOOLS

[75] Inventors: Cressie E. Holcombe, Jr., Farragut; Andrew H. Gorin, Knoxville; Roland D. Seals, Oak Ridge, all of Tenn.

[73] Assignee: Martin Marietta Energy Systems, Inc., Oak Ridge, Tenn.

[21] Appl. No.: 152,629

[22] Filed: Nov. 12, 1993

[51] Int. Cl.[5] ..... B24D 18/00

[52] U.S. Cl. ..... 51/293; 51/307; 106/638; 106/772; 106/713

[58] Field of Search ..... 51/293, 307; 106/638, 106/772, 713

[56] References Cited

U.S. PATENT DOCUMENTS

| | | | |
|---|---|---|---|
| 4,154,774 | 5/1979 | Hinterwaldner | 260/862 |
| 4,250,064 | 2/1981 | Chandler | 260/174 CL |
| 4,347,153 | 8/1982 | Hooper et al. | 252/174.25 |
| 4,424,203 | 1/1984 | Pakhomov et al. | 424/52 |
| 4,547,531 | 10/1985 | Waknine | 523/116 |
| 4,553,982 | 11/1985 | Korbel et al. | 51/298 |
| 4,760,882 | 8/1988 | Novak | 166/295 |
| 4,826,675 | 5/1989 | Gaffar et al. | 424/52 |
| 5,026,405 | 6/1991 | Guerro | 51/298 |
| 5,108,463 | 4/1992 | Buchanan | 51/298 |

OTHER PUBLICATIONS

Holcombe, Jr., *Specialty Zinc Oxide Cements*, Oct. 1983, pp. 14–24.

*Primary Examiner*—Mark L. Bell
*Assistant Examiner*—Deborah Jones
*Attorney, Agent, or Firm*—J. Kenneth Davis; Joseph A. Marasco; Harold W. Adams

[57] ABSTRACT

Abrasive grains such as boron carbide, silicon carbide, alumina, diamond, cubic boron nitride, and mullite are combined with a cement primarily comprised of zinc oxide and a reactive liquid setting agent and solidified into abrasive grinding tools. Such grinding tools are particularly suitable for grinding and polishing stone, such as marble and granite.

10 Claims, No Drawings

CERAMIC-BONDED ABRASIVE GRINDING TOOLS

The United States Government has rights in this invention pursuant to Contract No. DE-AC-05-84OR21400 between the United States Department of Energy and Martin Marietta Energy Systems, Inc. The invention was funded through Martin Marietta Energy Systems' Office of Technology Transfer, Regional Programs.

FIELD OF THE INVENTION

The present invention relates to grinding compositions and grinding tools and methods for making grinding compositions and grinding tools, and more particularly to grinding tools formed by bonding abrasive grains with modified dental (zinc oxide) cements.

BACKGROUND OF THE INVENTION

Need has long existed for inexpensive, easy-to-produce compositions for grinding tools which are used in the manufacture of articles made from stone such as marble and granite. Such grinding compositions must be easily formed into a solid, dense grinding tool body and must be simple enough to make that workers of ordinary skill can cast the grinding composition in grinding tool molds.

It has been common practice for the abrasive tools used in the manufacture of articles from stone, such as marble and granite, to be manufactured by a casting process using a magnesium oxide-magnesium chloride ("Sorel") cement and abrasive grains. This cement hardens without heating or other special processing. Abrasive grinding tool segments are generally formed by casting, and are attached to a rotating member to form a grinding wheel. This grinding wheel is rotated against the stone being polished or ground, either flooded by water or subjected to flowing water. The water serves to remove the debris resulting from grinding or polishing, to cool the grinding tools, and to prevent their becoming clogged or coated with debris. Because of their exposure to water, the grinding tools are subject to water reaction or dissolution. Therefore, one desirable characteristic of the cementitious phase is water insolubility.

Because the grinding tools are primarily subjected to compressive loads and because the stones being polished or ground are finished to the edge, resulting in the grinding tool passing beyond the edge of the stone, forces are generated which can cause chipping of the grinding tool. Fracture toughness is therefore a highly desirable property of the grinding material.

Because rapid wear of the grinding tool is undesirable, hardness is important. The abrasive grains must be very hard, and a desirable cementitious phase should be somewhat hard, although not excessively hard or brittle. Some flexibility is desirable in the grinding tool, became if the cementitious phase is somewhat flexible, there is less tendency for fracture during operation.

The "Sorel" cementitious material currently being used is lacking in water insolubility, fracture toughness, and flexibility. It is the lack of water insolubility, fracture toughness, and flexibility that the applicants' invention overcomes.

OBJECTS OF THE INVENTION

Accordingly, it is an object of the present invention to provide new and improved ceramic-bonded abrasive grinding compositions and grinding tools that are particularly useful for grinding and polishing stone such as marble and granite.

It is another object of the present invention to provide a relatively inexpensive and simple method for making new and improved ceramic-bonded abrasive grinding compositions and grinding tools that does not involve heating for setting or densification.

It is a further object of the present invention to provide a grinding composition having the following properties: water insolubility, strength, hardness, fracture toughness, and flexibility.

Further and other objects of the present invention will become apparent from the description contained herein.

SUMMARY OF THE INVENTION

In accordance with one aspect of the present invention, the foregoing and other objects are achieved by an abrasive composition which comprises abrasive grains dispersed throughout a solidified cement comprised of a product of a reaction of zinc oxide with a reactive liquid setting agent.

In accordance with another aspect of the present invention, a method of making an abrasive composition involves the steps of: combining abrasive grains, zinc oxide, and a reactive liquid setting agent to form a mixture; forming the mixture into a shape; and maintaining the shape for sufficient time for the zinc oxide to react with the reactive liquid setting agent to form a solidified cement.

In accordance with a further aspect of the present invention, an abrasive tool comprises a composite of abrasive grains dispersed throughout a solidified cement composed of a product of a reaction of zinc oxide with a reactive liquid setting agent, the composite forming an abrasive tool.

DETAILED DESCRIPTION OF THE INVENTION

Modified dental cements were prepared that have working times varying from a few seconds to a few hours, and setting times varying from a few minutes to 24 hours. Working time is defined as the time period between mixing of the cement and the time when the cement ceases to be moldable. Setting time Is defined as the time period between the end of the working time and the time that the cement is sufficiently set to be handled without deformation or breakage.

The cements are nearly or fully dense on setting and require no additional heat for densification. The cements are based on the reaction of zinc oxide with several liquid reactive setting agents, alone or as mixtures. Liquid reactive setting agents include ethoxyacetic acid (EOA), methoxyacetic acid (MOA), ethyl pyruvate (EP), acetylacetone (AA), ethyl acetoacetate (EA), eugenol, acetic acid, formic acid, lactic acid, pyruvic acid, guaiacol, and o-ethoxybenzoic acid (EBA). Modifiers added to the cements included dichloroethane, ethyl alcohol, ethylene glycol, butyl carbitol, diglyme ether, glycerine, and amyl acetate.

Examples of cements formed by the reaction of zinc oxide and reactive liquid setting agents are listed below in Table 1. The zinc oxide powder used was typically 2 to 50 micrometers agglomerate size, with actual particles about 0.3 micrometers average diameter. All liquid mixtures are by volume, and all acids are concentrated. L/P is defined as the ratio of liquid volume in $cm^3$ to powder weight in grams. Mixing can generally be done at room temperature. Working times and setting times are given in hours or minutes as noted. Relative hardness of the material was noted and assigned numerical values by determining the difficulty of penetrating the surface with a knife or spatula blade. Numbers assigned to hardness indicate: 1=very hard; 2=hard; 3=moderately hard; 4=slightly hard; and 5=soft.

Out of the many combinations investigated, only hard cements are listed in Table 1. Cements with a hardness rating or 1 or 2 have are most suitably hard for bonding abrasives to produce grinding or polishing compositions or tools. However, many of the working times are too short for practical use except for very small articles or batches. Also, it was found that some of the ingredients in the reactive liquids (such as lactic acid, EOA, AA, and to a lesser extent, acetic acid and formic acid) do not provide the desired water insolubility for wet grinding with water. Therefore, additional formulations were prepared using EBA as a major constituent.

TABLE 1

| Liquid | L/P | Working Time | Setting Time | Hardness |
|---|---|---|---|---|
| EOA alone | 1 | 2 min | 48 hr | 1 |
| EBA alone | 1 | 20 min | 4 hr | 2 |
| 50/50 lactic acid/acetic acid | 1 | 2 min | 60 min | 1 |
| 33/33/33 AA/formic acid/lactic acid | 1 | 1 min | 90 min | 2 |
| 33/33/33 acetic acid/EBA/formic acid | 1 | 1 min | 19 hr | 2 |
| 45/25/30 eugenol/acetic acid/AA | 1 | 1 min | 21 hr | 1 |
| 40/30/30 eugenol/acetic acid/AA | 1 | 1 min | 15 hr | 1 |
| 30/30/40 AA/acetic acid/eugenol | 1 | 1 min | 60 min | 1 |
| 45/45/10 acetic acid/AA/eugenol | 1 | 1 min | 60 min | 1 |
| 45/45/10 acetic acid/AA/diglyme ether | 1 | 1 min | 30 min | 1 |
| 45/45/10 AA/acetic acid/amyl acetate | 1 | 0.7 min | 30 min | 1 |
| 21/25/24/30 acetic acid/AA/formic acid/diglyme ether | 1 | 1.5 min | 17 hr | 1 |
| 35/35/30 acetic acid/AA/amyl acetate | 1 | 1 min | 15 min | 1 |
| 13/27/26/33 acetic acid/AA/formic acid/butyl carbitol | 1 | 1.5 min | 50 hr | 1 |
| 23/23/23/30 AA/EBA/formic acid/ethylene glycol | 1.3 | 0.8 min | 21 hr | 1 |
| 70/30 eugenol/EBA | 1.2 | 2 min | 20 hrs | 1 |
| 50/50 lactic acid/AA | 2.0 | 0.7 min | 40 min | 1 |
| 67/28/5 eugenol/EBA/AA | 1.1 | 2 min | 16 hr | 1 |
| 63/27/5/5 eugenol/EBA/acetic acid/lactic acid | 1 | 1 min | 30 min | 1 |
| 63/28/9 eugenol/EBA/formic acid | 1.4 | 2 min | 2.5 hr | 1 |
| 67/28/5 eugenol/EBA/pyruvic acid | 1.3 | 1.5 min | 60 min | 2 |
| 64/16/10/10 eugenol/acetic acid/AA/lactic acid | 1 | 0.7 min | 16 hr | 1 |
| 72/18/10 EBA/acetic acid/lactic acid | 1.5 | 0.5 min | 20 min | 1 |
| 90/10 AA/lactic acid | 1.5 | 0.8 min | 60 min | 1 |
| 64/16/10/10 eugenol/acetic acid/lactic acid/AA | 1.5 | 0.7 min | 17 hr | 1 |
| 64/16/20 eugenol/acetic acid/AA | 1 | 1 min | 60 min | 1 |
| 10/45/45 acetic acid/eugenol/AA | 2 | 0.8 min | 60 min | 1 |
| 45/10/45 acetic acid/lactic acid/AA | 1.1 | 0.5 min | 30 min | 1 |
| 45/10/45 acetic acid/EBA/AA | 1.2 | 1 min | 2 hr | 2 |
| 10/45/45 EBA/eugenol/AA | 1.2 | 2 min | 16 hr | 1 |
| 25/50/25 acetic acid/eugenol/AA | 1.7 | 0.8 min | 2 hr | 2 |
| 20/40/40 acetic acid/eugenol/AA | 1.3 | 1 min | 18 hr | 1 |
| 50/25/25 acetic acid/eugenol/AA | 1.6 | 1 min | 16 hr | 1 |
| 33/33/33 AA/EBA/formic acid | 1.5 | 1 min | 90 min | 1 |

Because the 70/30 eugenol/EBA mixture had a short working time, other ratios higher in EBA were investigated, using the minimum L/P ratio in order to increase strength and hardness. Results are shown in Table 2.

TABLE 2

| Liquid | L/P | Working Time | Setting Time | Hardness |
|---|---|---|---|---|
| 40/60 eugenol/EBA | 0.6 | 20 min | 2 hr | 2–3 |
| 30/70 eugenol/EBA | 0.6 | 20 min | 2 hr | 2 |
| 25/75 eugenol/EBA | 0.6 | 25 min | 2 hr | 1 |
| 20/80 eugenol/EBA | 0.6 | 40 min | 6 hr | 2 |
| 10/90 eugenol/EBA | 0.6 | 30 min | 6 hr | 2 |
| EBA alone | 0.6 | 20 min | 4 hr | 2–3 |

For mixing batches of cement large enough to make grinding and polishing tools suitable for use on large stone workpieces, it is desirable that the working time be about 15 minutes to about 30 minutes, preferably about 20 minutes to about 25 minutes. Setting times of about 2 hours to about 24 hours are generally considered acceptable; preferable setting times are about hours to about 8 hours.

For grinding or polishing tools which are used with water, water insolubility should be maximized. These and other considerations lead to the selection of the range of 0 to 40 vol % eugenol mixed with o-ethoxybenzoic acid (EBA) as a preferable reactive liquid setting agent. A range of 10 to 30 vol % is more desirable, and the most desirable mixture is 25 vol % eugenol and vol % EBA. The amounts of zinc oxide powder used were varied using the L/P ratios from 0.2 to 1.0 with the best performance occurring in the range of 0.4 to 0.75. An L/P ratio of 0,575 produced the overall best cement in terms of mechanical properties and pourability.

Hardness and working and setting times depend upon the L/P ratio and other specific characteristics of the constituents and the process. Larger particle-size zinc oxide is slower setting and often forms cements that are less hard. Additionally, the working and setting times can be varied by cooling and/or heating the powders, the liquids, or the mixture after initial mixing.

Varying the temperatures of the components before mixing or of the mixture after initial mixing in the range of −31° F. to 167° F. (−35° C. to 75° C.) appears to produce different relative amounts of crystalline plates and needles. Plates having a diameter of about 10 micrometers and a thickness of about 0.25 micrometers predominate at lower temperatures. Needles having a diameter of about 0.5 micrometers and a length of about 10 micrometers predominate at higher temperatures, as determined by scanning electron microscopy of fractured surfaces.

X-ray diffraction analyses revealed varying amounts of zinc eugenolate and o-ethoxybenzoate monohydrate as the primary phases in the above described cements.

The abrasive characteristics of an abrasive material used for grinding or polishing depend on the abrasive particles, their size, amount of loading (concentration in the cement), and the hardness inherent in their chemical and physical makeup.

The amount of loading of abrasive grains generally depends on the density of the particles, the material to be ground or polished, the relative cost of the abrasive grains, and perhaps personal preference. In general, lower loadings, typically in the 5 to 15 wt % range, are used with expensive materials like CBN, diamond, and $B_4C$. Grain or particle sizes used for the abrasive grain loadings typically vary from 16 grit (1660 micrometers) to 1200 grit (3 micrometers). The most used range of abrasive grain loading sizes is 36 grit (710 micrometers) to 120 grit (142 micrometers).

Separate sets of grinding tools are generally made using abrasive grains of progressively finer grit sizes (36 grit, 120 grit, 320 grit and 800 grit respectively) at loadings of about 25 wt % to about 50 wt % with zinc powder and reactive liquid setting agent composed of 25 vol % eugenol and 75 vol % EBA. Many types of stone are wet-ground using successive operations with grinding tools of progressively finer grit sizes.

The properties of the grinding composition can be varied by adding calcium oxide, magnesium oxide, yttrium oxide, Portland cement, plaster-of-paris, or other fillers and micro-concrete additives. Micro-concretes are those with filler materials with particle sizes below 44 micrometers in average particle diameter below 280 grit.

Examples of microconcretes with 75 wt % zinc oxide and 25 wt % alumina are as follows:

EXAMPLE I

Fine alumina powder of no greater than 325 mesh (280 grit), having an average particle diameter of 5 micrometers (1000 grit) was combined with zinc oxide in a 25/75 wt % ratio to form a dry mix. The dry mix was combined with a reactive liquid setting agent composed of 25 vol % eugenol and 75 vol % EBA at a 0.6 L/P ratio. The resulting material had a working time of 25 minutes, a setting time of 2 hours, and a relative hardness of 1.

EXAMPLE II

Coarse alumina powder of no greater than 60 mesh (80 grit), having an average particle diameter of less than 250 micrometers was combined with zinc oxide in a 25/75 wt % ratio to form a dry mix. The dry mix was combined with reactive liquid setting agent composed of 25 vol % eugenol and 75 vol % EBA at a 0.5 L/P ratio. The resulting material had a working time of 25 minutes, a setting time of 2 hours, and a relative hardness of 1.

Improved lightweight grinding compositions are desirable for some applications. By adding hollow alumina or mullite spheres, porosity and lightweighthess can be achieved while improving hardness. Moreover, it is believed that hollow, essentially spherically-shaped abrasive grains provide a more aggressive grinding action because as the hollow grains are fractured through wear, new edges of the fractured grains are continually being exposed.

EXAMPLE III

A 5.45 gram quantity of monosized hollow alumina spheres, approximately 0. 1 inch in diameter, was combined with 20 grams of zinc oxide powder and 11.5 grams of reactive liquid setting agent composed of 25 vol % eugenol and 75 vol % EBA (L/P ratio=0.4). The resulting material had a working time of 25 minutes, a setting time of 2 hours, and a relative hardness of 1.

EXAMPLE IV 380 grams of zinc oxide and 220 grams of reactive liquid setting agent composed of 23 vol % eugenol and 77 vol % EBA were mixed with 200 grams of silicon carbide abrasive grains of 60 grit size to form a pourable mixture. The mixture was poured into cylindrical molds to form six grinding tools of about 3.5 inches in diameter and 0.25 inch thickness. Three of the grinding tools were allowed to set at room temperature (68° F.), and three of the grinding tools were allowed to set at 100° F., heat being provided by a heat lamp.

The grinding tools which were allowed to set at room temperature exhibited a working time of approximately 20 minutes and a setting time of approximately 45 minutes. The grinding tools which were allowed to set at 100° F exhibited a shortened setting time of about 20 minutes.

Powdered resins, such as phenolic or furan resins, can be added to the zinc oxide powder along with the filler abrasive particles to modify the properties of the grinding composition or tool, such as for improving fracture resistance. Liquid additions, such as epoxy resins are also useful for maintaining a homogeneous mixture (preventing the abrasive grains from settling) during the setting time.

EXAMPLE V 380 grams of zinc oxide were combined with 200 grams of silicon carbide abrasive grains of 60 grit size and 60 grams of phenolic resin to form a dry mix. The dry mix was combined with a reactive liquid setting agent composed of 23 vol % eugenol and 77 vol % EBA mixture, followed by molding and setting as described in Example IV. Also as in example IV, the setting time was accelerated by the 100° F. curing temperature, to about 20 minutes. The six grinding tools were subsequently heated to 250° F. to polymerize the resin. No degradation of grinding tool quality was caused by the 250° F. heating.

Additional materials such as well known, conventional fillers and resins may be added to the cement to modify its properties and thus provide grinding tools that better meet the needs of specific grinding and polishing applications. Suitable fillers include, but are not limited to, calcium oxide, magnesium oxide, yttrium oxide, portland cement, plaster-of-paris, aluminum oxide, silicon oxide, and mixtures thereof. Suitable resins include, but are not limited to, phenolic resins, furan resins, epoxy resins, and mixtures thereof. Slowly heating resin-containing grinding tools to 300° F. (149° C.), after the cement is hardened, results in a polymer phase which is interlockingly bonded to the cement, enhancing water resistance and flexibility.

The grinding tool may be improved for some applications by the addition of a metal filler, composed of turnings, fibers, or rods. The metal filler causes the composite to behave like a metal-backed abrasive tool, improving the wear and fracture resistance.

Since cerium oxide or ceria ($CeO_2$) is known as an excellent material for polishing glass, the addition or substitution of ceria to the above described cast abrasive grinding compositions is useful. The fluoride ($CeF_3$) is known for its lubricity. Thus, the combination of ceria/cerium fluoride allows a greatly improved surface finish when these compositions are used for polishing. Likewise, stannic oxide or tin oxide ($SnO_2$) is known to be useful for glass polishing, the fluoride ($SnF_2$) having lubricity. Thus the tin oxide/tin fluoride combination provides an alternative to the ceria/cerium fluoride system.

While there has been shown and described what are at present considered the preferred embodiments of the invention, it will be obvious to those skilled in the art that various changes and modifications can be made therein without departing from the scope of the inventions defined by the appended claims.

What is claimed is:

1. An abrasive composition comprising abrasive grains dispersed throughout a solidified cement comprising a product of a reaction of zinc oxide with a reactive liquid setting agent selected from the group consisting of ethoxyacetic acid, methoxyacetic acid, ethyl acetoacetate, ethyl pyruvate, acetylacetone, eugenol, acetic acid, formic acid, lactic acid, pyruvic acid, guaiacol, o-ethoxybenzoic acid, and mixtures thereof.

2. The abrasive composition described in claim 1 wherein said abrasive grains are selected from the group consisting of boron carbide, silicon carbide, alumina, diamond, cubic boron nitride, mullite, and mixtures thereof.

3. The abrasive composition described in claim 1 further comprising a modifier selected from the group consisting of dichloroethane, ethyl alcohol, ethylene glycol, butyl carbitol, diglyme ether, glycerine, amyl acetate, and mixtures thereof.

4. The abrasive composition described in claim 1 further comprising a filler selected from the group consisting of calcium oxide, magnesium oxide, yttrium oxide, portland cement, plaster-of-paris, aluminum oxide, silicon oxide, and mixtures thereof.

5. A method of making an abrasive composition comprising the steps of:

(a) combining abrasive grains, zinc oxide, and a reactive liquid setting agent selected from the group consisting of ethoxyacetic acid, methoxyacetic acid, ethyl acetoacetate, ethyl pyruvate, acetylacetone, eugenol, acetic acid, formic acid, lactic acid, pyruvic acid, guaiacol, o-ethoxybenzoic acid, and mixtures thereof to form a mixture;

(b) forming said mixture into a shape; and (c) maintaining said shape for sufficient time for said zinc oxide to react with said reactive liquid setting agent to form a solidified cement.

6. The method described in claim 5 wherein said abrasive grains are selected from the group consisting of boron carbide, silicon carbide, alumina, diamond, cubic boron nitride, mullite, and mixtures thereof;

7. The method described in claim 5 wherein said mixture further comprises a modifier selected from the group consisting of dichloroethane, ethyl alcohol, ethylene glycol, butyl carbitol, diglyme ether, glycerine, amyl acetate, and mixtures thereof.

8. The method described in claim 5 wherein said mixture further comprises a filler selected from the group consisting of calcium oxide, magnesium oxide, yttrium oxide, portland cement, plaster-of-paris, aluminum oxide, silicon oxide, and mixtures thereof.

9. An abrasive tool comprising a composite of abrasive grains dispersed throughout a solidified cement comprising a product of a reaction of zinc oxide with a reactive liquid setting agent selected from the group consisting of ethoxyacetic acid, methoxyacetic acid, ethyl acetoacetate, ethyl pyruvate, acetylacetone, eugenol, acetic acid, formic acid, lactic acid, pyruvic acid, guaiacol, o-ethoxybenzoic acid, and mixtures thereof.

10. The composition described in claim 1 wherein said abrasive grains are hollow.

* * * * *